US006392176B1

(12) United States Patent
Tsai

(10) Patent No.: US 6,392,176 B1
(45) Date of Patent: May 21, 2002

(54) KEYSWITCH OF KEYBOARD

(75) Inventor: Ching Cheng Tsai, Keelung (TW)

(73) Assignee: Chicony Electronics Co., Ltd., Taipei Hsien (TW)

( * ) Notice: Subject to any disclaimer, the term of this patent is extended or adjusted under 35 U.S.C. 154(b) by 0 days.

(21) Appl. No.: 09/797,560

(22) Filed: Mar. 5, 2001

(51) Int. Cl.[7] ..... H01H 13/70
(52) U.S. Cl. ..... 200/344
(58) Field of Search ..... 200/5 A, 517, 200/344, 345; 400/490–496

(56) References Cited

U.S. PATENT DOCUMENTS 5,829,579 A * 11/1998 Tsai ..... 200/344
6,031,189 A * 2/2000 Watanabe et al. ..... 200/5 A
6,156,985 A * 12/2000 Chiang ..... 200/344
6,160,233 A * 12/2000 Hu ..... 200/344
6,179,497 B1 * 1/2001 Hu ..... 400/495

* cited by examiner

*Primary Examiner*—Michael Friedhofer
(74) *Attorney, Agent, or Firm*—Rosenberg, Klein & Lee

(57) ABSTRACT

A keyswitch comprises a keytop, a resilient dome, a first lever, a second lever and a base with pivotal stages. The first lever has two convex parts on centers of two lateral sides thereof and the second lever has two concave parts on centers of two lateral sides thereof and corresponding to the two convex parts. The convex part has an opened groove and the concave part has a pivotal rod corresponding to the opened groove and pivotally arranged into the opened groove. Therefore, the first lever can be vertically assembled to the second lever. The second lever has two clamping parts on two lateral sides thereof and clamping the pivotal stages of the base. Therefore, the first lever and the second lever are firmly retained on the base and stably guide the keytop such that the keytop will not be shaken during operation.

5 Claims, 4 Drawing Sheets

KEYSWITCH OF KEYBOARD

FIELD OF THE INVENTION

The present invention relates to a keyswitch, especially to a keyswitch assembled from top direction to simply process and prevent lateral shake.

BACKGROUND OF THE INVENTION

FIG. 1 shows a conventional computer keyswitch, which is a lever type keyswitch and comprises a keytop 10*a,* a resilient dome 11*a,* a first lever 12*a,* a second lever 13*a* and a base 14*a*. The first lever 12*a* and the second lever 13*a* are in scissors arrangement. The first lever 12*a* has a pivotal shaft 15*a* on bottom thereof and the second lever 13*a* has a pivotal shaft 16*a* on bottom thereof, the pivotal shafts 15*a* and 16*a* are pivotally arranged into pivotal stages 17*a* and 18*a* on top of the base 14*a*. The top end of the first lever 12*a* and the second lever 13*a* are pivotally arranged into bottom of the keytop 10*a,* whereby the first lever 12*a* and the second lever 13*a* forms a link mechanism. The resilient dome 11*a* is placed within the moving stroke of the keytop 10*a*. When the keytop 10*a* is pressed downward or lifted upward; and guided by the first lever 12*a* and the second lever 13*a,* the resilient dome 11*a* below the keytop 10*a* can switch on and off the membrane circuit 19*a*.

However, in above-mentioned keyswitch with a first lever 12*a* and a second lever 13*a* in scissors arrangement, the first lever 12*a* and the second lever 13*a* should be assembled along a specific inclined angle. The assembling thereof is cumbersome, and hard to automatic.

Moreover, in above-mentioned keyswitch, the pivotal shafts 15*a* and 16*a* of the first lever 12*a* and the second lever 13*a* are pivotally arranged into pivotal stages 17*a* and 18*a* on top of the base 14*a*. The first lever 12*a* and the second lever 13*a* cannot be firmly retained by the base 14*a*. The keytop 10*a* is shaken during key pressing operation.

Moreover, in above-mentioned keyswitch, the pivotal stages 17*a* and 18*a* of the base 14*a* have the problem of material congestion when being bent. The pivotal shafts 15*a* and 16*a* of the first lever 12*a* and the second lever 13*a* cannot be tightly fit into the pivotal stages 17*a* and 18*a* on top of the base 14*a*. The first lever 12*a* and the second lever 13*a* cannot be firmly retained by the base 14*a*.

SUMMARY OF THE INVENTION

It is an object of the present invention to provide a keyswitch wherein the first lever thereof can be vertically assembled to the second lever thereof. The assembling of the lever mechanism in the present invention does need specific inclined angle and cumbersome process.

It is another object of the present invention to provide a keyswitch when the two lower pivotal shafts of the second lever thereof are pivotally arranged in the second pivotal stages, the two clamping parts below the second lever clamp the second pivotal stages, respectively. Therefore, the first lever and the second lever are firmly retained on the base and stably guide the keytop such that the keytop will not be shaken during operation.

It is another object of the present invention to provide a keyswitch wherein the first pivotal stage thereof has two broken edges on two lateral bending sides thereof, the first pivotal stage will not have the problem of material congestion during manufacture. The lower pivotal shaft on bottom of the first lever is precisely arranged in the first pivotal stage. Therefore, the first lever and the second lever are firmly retained on the base and stably guide the keytop.

To achieve above object, the present invention provides a keyswitch comprising a keytop, a resilient dome, a first lever, a second lever and a base with pivotal stages. The first lever has two convex parts on centers of two lateral sides thereof and the second lever has two concave parts on centers of two lateral sides thereof and corresponding to the two convex parts. The convex part has an opened groove and the concave part has a pivotal rod corresponding to the opened groove and pivotally arranged into the opened groove. Therefore, the first lever can be vertically assembled to the second lever. The second lever has two clamping parts on two lateral sides thereof and clamping the pivotal stages of the base. Therefore, the first lever and the second lever are firmly retained on the base and stably guide the keytop such that the keytop will not be shaken during operation.

The various objects and advantages of the present invention will be more readily understood from the following detailed description when read in conjunction with the appended drawing, in which:

DETAILED DESCRIPTION OF THE INVENTION

Figure 1:
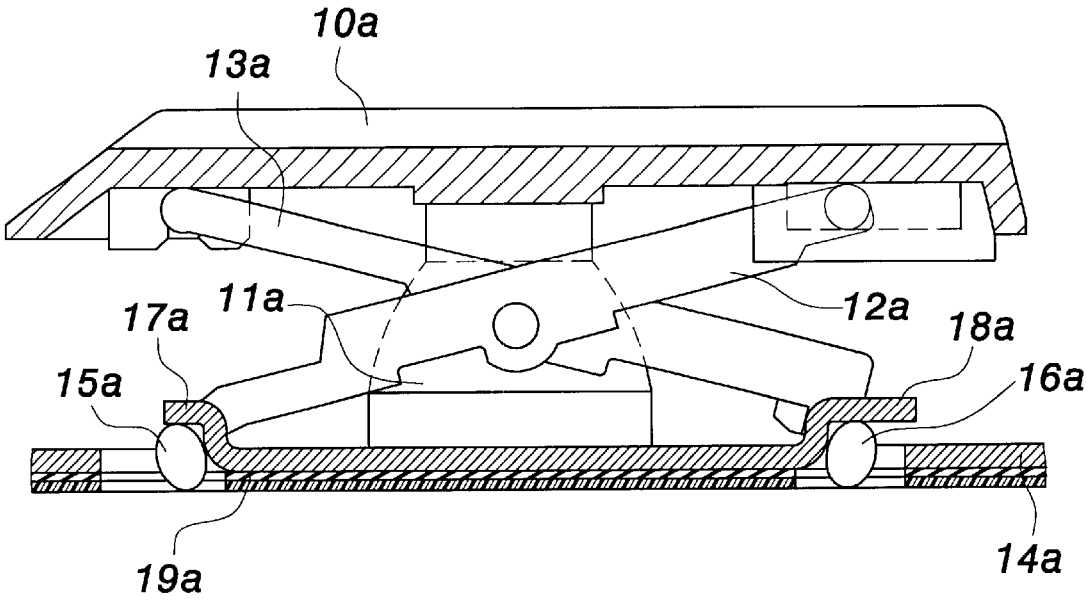
FIG. 1 PRIOR ART
FIG. 1 shows the sectional view of prior art keyswitch.
Figure 2:
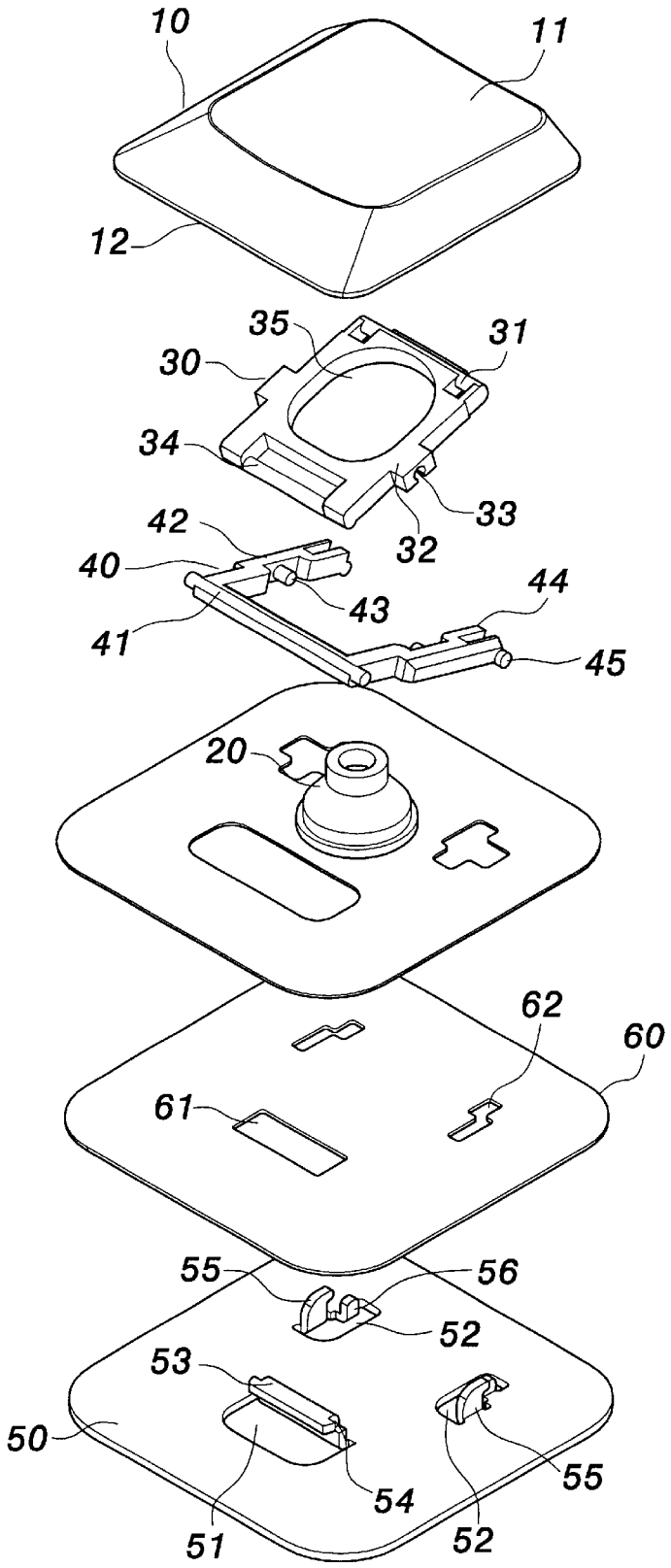
FIG. 2 shows the exploded view of the keyswitch of the present invention.
Figure 3:
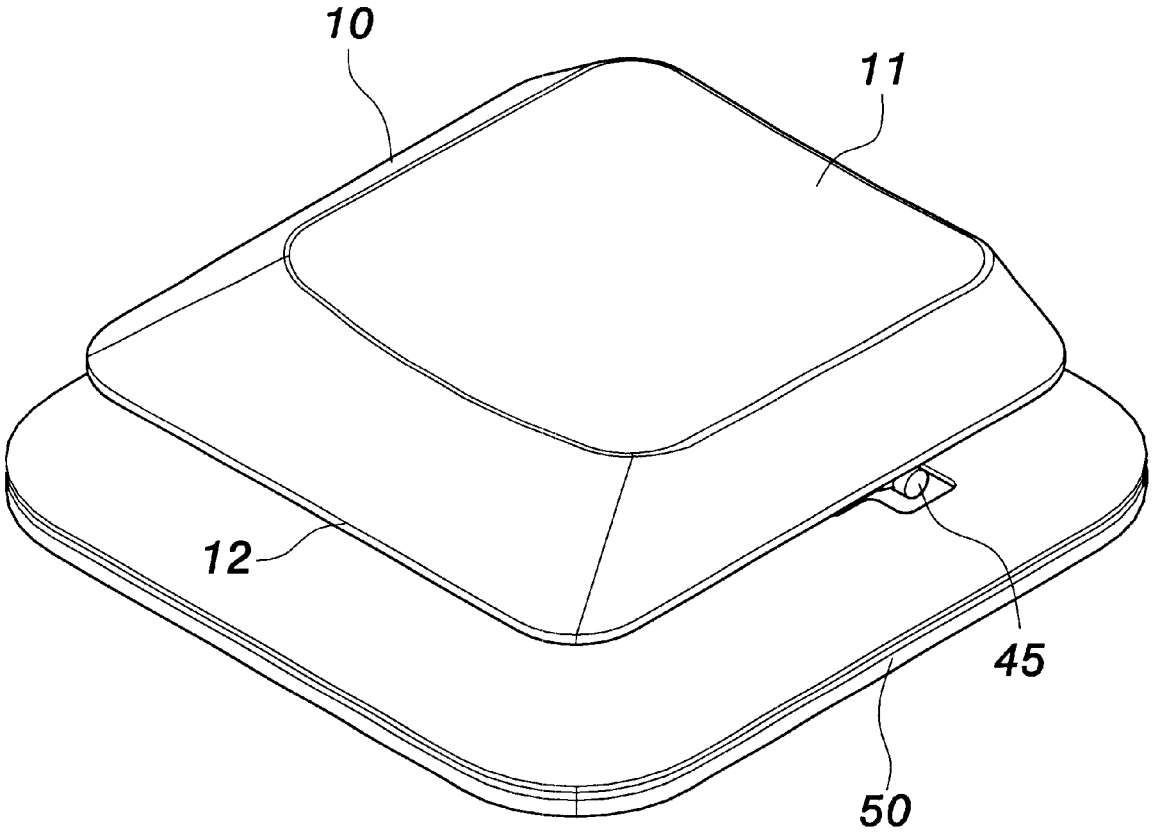
FIG. 3 shows the perspective view of the keyswitch of the present invention.
Figure 4:
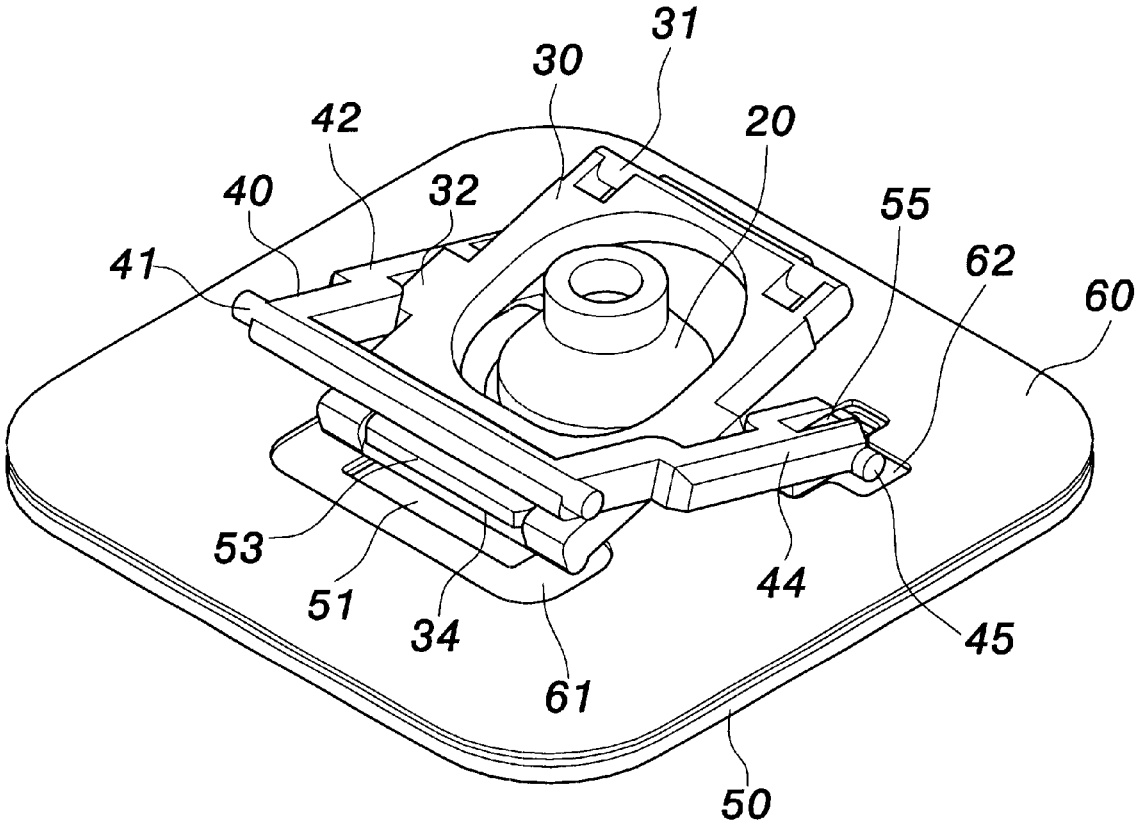
FIG. 4 shows the perspective view of the keyswitch of the present invention with the keytop being removed.

With reference now to FIGS. 2, 3, and 4, the present invention provides a keyswitch suitable for the keyboard of notebook computer. The keyswitch of the present invention comprises a keytop 10, a resilient dome 20, a first lever 30, a second lever 40 and a base 50. The keytop 10 is of rectangular cap shape with an operative surface 11 on topside thereof and an assembling surface 12 on bottom side thereof.

The resilient dome 20 is made of resilient material such as rubber and arranged below the keytop 10 and between the keytop 10 and the base 50. The resilient dome 20 is placed within the key-pressing stroke of the keytop 10 and provides an upward restoring force to the keytop 10.

The first lever 30 and the second lever 40 are arranged between the assembling surface 12 of the keytop 10 and the base 50. The first lever 30 is of hollow frame shape and has a through hole 35 through which the resilient dome 20 passes. The second lever 40 is a U-shaped rack. The first lever 30 has an upper pivotal shaft 31 on topside thereof and the second lever 40 has an upper pivotal shaft 41 on topside thereof, the pivotal shafts 31 and 41 are pivotally connected to the assembling surface 12. The first lever 30 is smaller than the second lever 40 such that the first lever 30 is fit within the second lever 40. The first lever 30 has two convex parts 32 on centers of two lateral sides thereof; the second lever 40 has two concave parts 42 on centers of two lateral sides thereof and corresponding to the two convex parts 32 of the first lever 30. The convex part 32 has an opened groove 33 and the concave part 42 has a pivotal rod 43 corresponding to the opened groove 33 and pivotally arranged into the opened groove 33. Therefore, the first lever 30 and the second lever 40 can be assembled in scissors arrangement.

The first lever 30 has a lower pivotal shaft 34 on bottom thereof and pivotally connected to the base 50. The second lever 40 has two U-shaped clamping parts 44 on two lateral sides thereof. The second lever 40 has two lower pivotal shafts 45 pivotally connected to the base 50.

The base 50 is arranged below the keytop 10, the resilient dome 20, the first lever 30, and the second lever 40. The base 50 has a first through hole 51 and two second through holes 52 corresponding to the lower pivotal shaft 34 on bottom of the first lever 30 and the two lower pivotal shafts 45 on bottom of the second lever 40. The first through hole 51 has an upward-extended first pivotal stage 53 of L-shape. The first pivotal stage 53 has two broken edges 54 on two lateral bending sides thereof. The second through hole 52 has an upward-extended second pivotal stage 55 of L-shape and a baffle plate 56 beside the second pivotal stage 55.

The lower pivotal shaft 34 on bottom of the first lever 30 is pivotally arranged in the first pivotal stage 53 and the first pivotal stage 53 retains the upward movement of the lower pivotal shaft 34 of the first lever 30. The two lower pivotal shafts 45 of the second lever 40 are pivotally arranged in the second pivotal stages 55; and the second pivotal stages 55 retain the upward movement of the two lower pivotal shafts 45 of the second lever 40. Moreover, the two U-shaped clamping parts 44 on two lateral sides of the second lever 40 clamp the second pivotal stages 55, respectively.

Moreover, a membrane circuit 60 is arranged between the base 50 and the resilient dome 20 and has openings 61 and 62 corresponding to the lower pivotal shaft 34 of the first lever 30 and the two lower pivotal shafts 45 of the second lever 40. Therefore, the lower pivotal shaft 34 of the first lever 30 passes the opening 61 and is pivotally arranged in the first pivotal stage 53; the two lower pivotal shafts 45 of the second lever 40 pass the openings 62 and are pivotally arranged in the second pivotal stages 55, respectively.

When the keytop 10 is pressed downward or lifted upward; and guided by the first lever 30 and the second lever 40, the resilient dome 20 below the keytop 10 can switch on and off the membrane circuit 60.

The first lever 30 has two convex parts 32 on centers of two lateral sides thereof and the second lever 40 has two concave parts 42 on centers of two lateral sides thereof. The convex part 32 has an opened groove 33 and the concave part 42 has a pivotal rod 43 corresponding to the opened groove 33 and pivotally arranged into the opened groove 33. Therefore, the first lever 30 can be directly assembled to the second lever 40 in vertically down direction. The assembling of the lever mechanism in the present invention does need specific inclined angle and cumbersome process.

When the two lower pivotal shafts 45 of the second lever 40 pass the openings 62 and are pivotally arranged in the second pivotal stages 55, the two U-shaped clamping parts 44 clamp the second pivotal stages 55, respectively. Therefore, the first lever 30 and the second lever 40 are firmly retained on the base 50 and stably guide the keytop 10 such that the keytop 10 will not be shaken during operation.

Moreover, the first pivotal stage 53 has two broken edges 54 on two lateral bending sides thereof, the first pivotal stage 53 will not have the problem of material congestion during manufacture. The lower pivotal shaft 34 on bottom of the first lever 30 is precisely arranged in the first pivotal stage 53. Therefore, the first lever 30 and the second lever 40 are firmly retained on the base 50 and stably guide the keytop 10.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A keyswitch comprising:

a keytop defining a bottom assembling surface;

a resilient dome disposed below said keytop;

a first lever having a first top end portion coupled to said assembling surface of said keytop, said first lever including a first pivotal shaft and pair of first lateral side portions extending therefrom to said first top end portion, said first lever defining a through hole for receiving said resilient dome, each said first lateral side portion having intermediately protruding therefrom a convex part having an axially extended opened groove formed therein;

a second lever having a second top end portion coupled to said assembling surface of said keytop, said second lever including a pair of second lateral side portions extending from said second top end portion, each said second lateral side portion defining an intermediate concave part having a pivotal rod projecting therefrom to pivotally engage said opened groove of one said first lateral side portion convex part, each said second lateral side portion having formed at a free end thereof a clamping part and a second pivotal shaft; and, a base disposed below said keytop, said resilient dome, and said first and second levers, said base having formed therein a first through hole and a pair of second through holes, said base including:

a first pivotal stage defining a raised portion disposed adjacent said first through hole to engage said first pivotal shaft, said first raised portion having an elongate intermediate portion extending laterally between a pair of broken edges;

a pair of second pivotal stages each defining a second raised portion disposed adjacent one of said second through holes to engage in pivotally displaceable manner one of said second pivotal shafts, each said second pivotal stage engaging one of said clamping parts; and, a pair of baffle plates each disposed adjacent one of said second pivotal stages.

2. A keyswitch comprising:

a keytop defining a bottom assembling surface;

a resilient dome disposed below said keytop;

a first lever having a first top end portion coupled to said assembling surface of said keytop, said first lever including a pair of first lateral side portions extending from said first top end portion and defining a through hole for receiving said resilient dome, each said first lateral side portion having intermediately protruding therefrom a convex part;

a second lever having a second top end portion coupled to said assembling surface of said keytop, said second lever including a pair of second lateral side portions extending from said second top end portion, each said second lateral side portion defining an intermediate concave part, each said concave part receiving one said convex part in substantially conforming manner to form a pivotal joint thereat;

one of said concave and convex parts at each said pivotal joint having an axially extended opened groove formed therein, and the other of said concave and convex parts at each said pivotal joint having a pivotal rod projecting therefrom to coaxially engage in pivotally displaceable manner said opened groove, said opened groove defining a slotted axial opening for receiving said pivotal rod transversely therethrough in snap fit manner; and, a base disposed below said keytop, said resilient dome, and said first and second levers, said base engaging a bottom end portion of each of said first and second levers.

3. The keyswitch as recited in claim 2 wherein said first and second top end portions respectively include first and second upper pivotal shafts pivotally coupled to said assembling surface of said keytop.

4. A keyswitch comprising:

a keytop defining a bottom assembling surface;

a resilient dome disposed below said keytop;

a first lever having a first top end portion coupled to said assembling surface of said keytop, said first lever including a pair of first lateral side portions extending from said first top end portion and defining a through hole for receiving said resilient dome, each said first lateral side portion having intermediately protruding therefrom a convex part;

a second lever having a second top end portion coupled to said assembling surface of said keytop, said second lever including a pair of second lateral side portions extending from said second top end portion, each said second lateral side portion defining an intermediate concave part, each said concave part receiving one said convex part to form a pivotal joint thereat;

one of said concave and convex parts at each said pivotal joint having an axially extended opened groove formed therein, and the other of said concave and convex parts at each said pivotal joint having a pivotal rod projecting therefrom to coaxially engage in pivotally displaceable manner said opened groove; and, a base disposed below said keytop, said resilient dome, and said first and second levers, said base engaging a bottom end portion of each of said first and second levers;

said first lever including a first pivotal shaft, and each said second lateral side portion of said second lever having formed at a free end thereof a clamping part and a second pivotal shaft.

5. The keyswitch as recited in claim 4 wherein said base includes:

a first pivotal stage defining a raised portion disposed adjacent said first through hole to engage said first pivotal shaft, said first raised portion having an elongate intermediate portion extending laterally between a pair of broken edges;

a pair of second pivotal stages each defining a second raised portion disposed adjacent one of said second through holes to engage in pivotally displaceable manner one of said second pivotal shafts, each said second pivotal stage engaging one of said clamping parts; and, a pair of baffle plates each disposed adjacent one of said second pivotal stages.

* * * * *